US007263940B2

(12) United States Patent
Yetter et al.

(10) Patent No.: US 7,263,940 B2
(45) **Date of Patent: *Sep. 4, 2007**

(54) PONTOON FRAME AND ADJUSTABLE MOTOR MOUNT

(76) Inventors: Lloyd Yetter, P.O. Box 261, Colchester, IL (US) 62326; Roger Yetter, P.O. Box 261, Colchester, IL (US) 62326

( * ) Notice: Subject to any disclaimer, the term of this patent is extended or adjusted under 35 U.S.C. 154(b) by 0 days.

This patent is subject to a terminal disclaimer.

(21) Appl. No.: 11/342,464

(22) Filed: Jan. 30, 2006

(65) Prior Publication Data

US 2006/0130725 A1 Jun. 22, 2006

Related U.S. Application Data

(63) Continuation of application No. 10/865,089, filed on Jun. 10, 2004, now Pat. No. 7,004,092.

(60) Provisional application No. 60/477,286, filed on Jun. 10, 2003.

(51) Int. Cl.
*B63B 1/00* (2006.01)
*B63B 35/44* (2006.01)

(52) U.S. Cl. ..... 114/61.1; 114/267

(58) Field of Classification Search ..... 114/61.22, 114/266, 267, 292, 352, 61.1
See application file for complete search history.

(56) References Cited

U.S. PATENT DOCUMENTS 2,745,118 A * 5/1956 Potts et al. ..... 114/345
2,916,748 A * 12/1959 Stahmer ..... 114/352
3,614,937 A * 10/1971 Schulman ..... 114/283
3,673,976 A * 7/1972 Reynolds ..... 114/61.22
3,968,532 A * 7/1976 Bailey ..... 114/352
3,986,219 A * 10/1976 Michowski ..... 114/354
4,040,134 A * 8/1977 Downing ..... 114/354
4,768,456 A * 9/1988 Jones et al. ..... 114/266
4,777,898 A * 10/1988 Faulkner ..... 114/61.1
4,829,926 A * 5/1989 Voelkel ..... 114/61.22
4,856,446 A * 8/1989 Herard ..... 114/61.22
4,892,052 A * 1/1990 Zook et al. ..... 114/85
4,993,340 A * 2/1991 Pepper ..... 114/61.22
4,993,350 A * 2/1991 Pepper ..... 114/292
5,237,954 A * 8/1993 Evans ..... 114/352
5,315,947 A * 5/1994 Knight ..... 114/61.15
5,540,169 A * 7/1996 Davis et al. ..... 114/61.1
5,542,370 A * 8/1996 Castleberry ..... 114/352
5,706,752 A * 1/1998 Menne et al. ..... 114/361
5,803,007 A * 9/1998 Stevens ..... 114/266
6,234,098 B1 * 5/2001 Biedenweg et al. ..... 114/85
6,302,042 B1 * 10/2001 Biedenweg et al. ..... 114/61.22
6,481,737 B2 * 11/2002 Dray ..... 280/414.1
6,508,194 B2 * 1/2003 Myers ..... 114/354
6,644,229 B1 * 11/2003 Davenport ..... 114/61.1
7,004,092 B2 * 2/2006 Yetter et al. ..... 114/61.22

* cited by examiner

*Primary Examiner*—Jesús D. Sotelo
(74) *Attorney, Agent, or Firm*—Mark E. Wiemelt; Robert L. Knechtel

(57) ABSTRACT

A float structure having a mainframe and pontoons is described. The mainframe includes floor support beams transversely attached to pontoon connector beams. The pontoon connector beams are operatively connected to the pontoons such that there are no weak points in the mainframe. A motor mount is removably mounted to the connector beams and is adjustable to accommodate various lengths of motor shafts.

8 Claims, 6 Drawing Sheets

PONTOON FRAME AND ADJUSTABLE MOTOR MOUNT

CROSS REFERENCE TO RELATED APPLICATIONS

This application is a continuation of U.S. patent application Ser. No. 10/865,089 filed on Jun. 10, 2004, now U.S. Pat. No. 7,004,092, issued Feb. 28, 2006. This application claims priority from U.S. Provisional Patent Application No. 60/477,286 filed Jun. 10, 2003.

STATEMENT REGARDING FEDERALLY SPONSORED RESEARCH

Not Applicable.

APPENDIX

Not Applicable.

BACKGROUND OF THE INVENTION

1. Field of the Invention

The present invention relates generally to pontoon boats and, more particularly, to a pontoon frame for a pontoon boat, pontoon dock, pontoon duck blind and pontoon working platform and adjustable motor mount for a pontoon boat.

2. Description of the Related Art

A pontoon boat consists of pontoons harnessed together by a mainframe. A deck is mounted to the mainframe, and a railing, canopy, motor mount and other accessories are mounted to the deck. A significant disadvantage with this type of construction is that the elements making up the framework are sized according to the size of the pontoon boat ordered. As such, manufacturers must produce various sized framework elements.

Typically, a pontoon boat is shipped unassembled to a purchaser via carrier. If the pontoon boat is shipped with the mainframe assembled, the shipping cost is relatively high. Moreover, finding a carrier capable of shipping such a large item is difficult. Alternatively, if the pontoon boat is shipped with the mainframe unassembled as a kit, the purchaser must be mechanically inclined to assemble the pontoon boat. Moreover, the time and effort of assembling the pontoon boat is excessive.

A motor mount for a pontoon boat is mounted to an undercarriage or to the deck but not on the deck. The motor mount extends out from the deck. Typically, a motor mount is designed to accommodate a short or long shaft motor, but not both types of shafts. There is a need to have a motor mount that will accommodate various shaft lengths such that the motor mount is universal.

The present invention is directed to overcoming one or more of the problems set forth above.

SUMMARY OF THE INVENTION

An aspect of the present invention is to provide a mainframe and motor mount for overcoming one or more of the problems set forth above.

Another aspect of the invention is to provide a mainframe that breaks down into common sized elements regardless of the pontoon boat size.

In another aspect of the invention there is provided a mainframe that is assembled with ease.

In another aspect of the invention there is provided common elements which may be combined to provide an unlimited number of float structure arrangements.

In still another aspect of the invention there is provided horizontal supports abutting each other at a location offset from the location where the in-line horizontal pontoons abut each other.

In yet another aspect of the invention there is provided a kit containing all of the parts for constructing a pontoon boat with relative ease and effort.

These, and other aspects and advantages of the present invention, will become apparent from the following detailed description. The above listing of aspects of the invention should not be deemed as all-inclusive in any manner whatsoever.

BRIEF DESCRIPTION OF THE DRAWINGS

Reference is now made to the drawings, which illustrate the best known mode of carrying out the invention and wherein the same reference characters indicate the same or similar parts throughout the views.

FIG. 6 is an exploded view of horizontal members of the mainframe and the pontoons according to FIG. 1.

DETAILED DESCRIPTION

Figure 1:
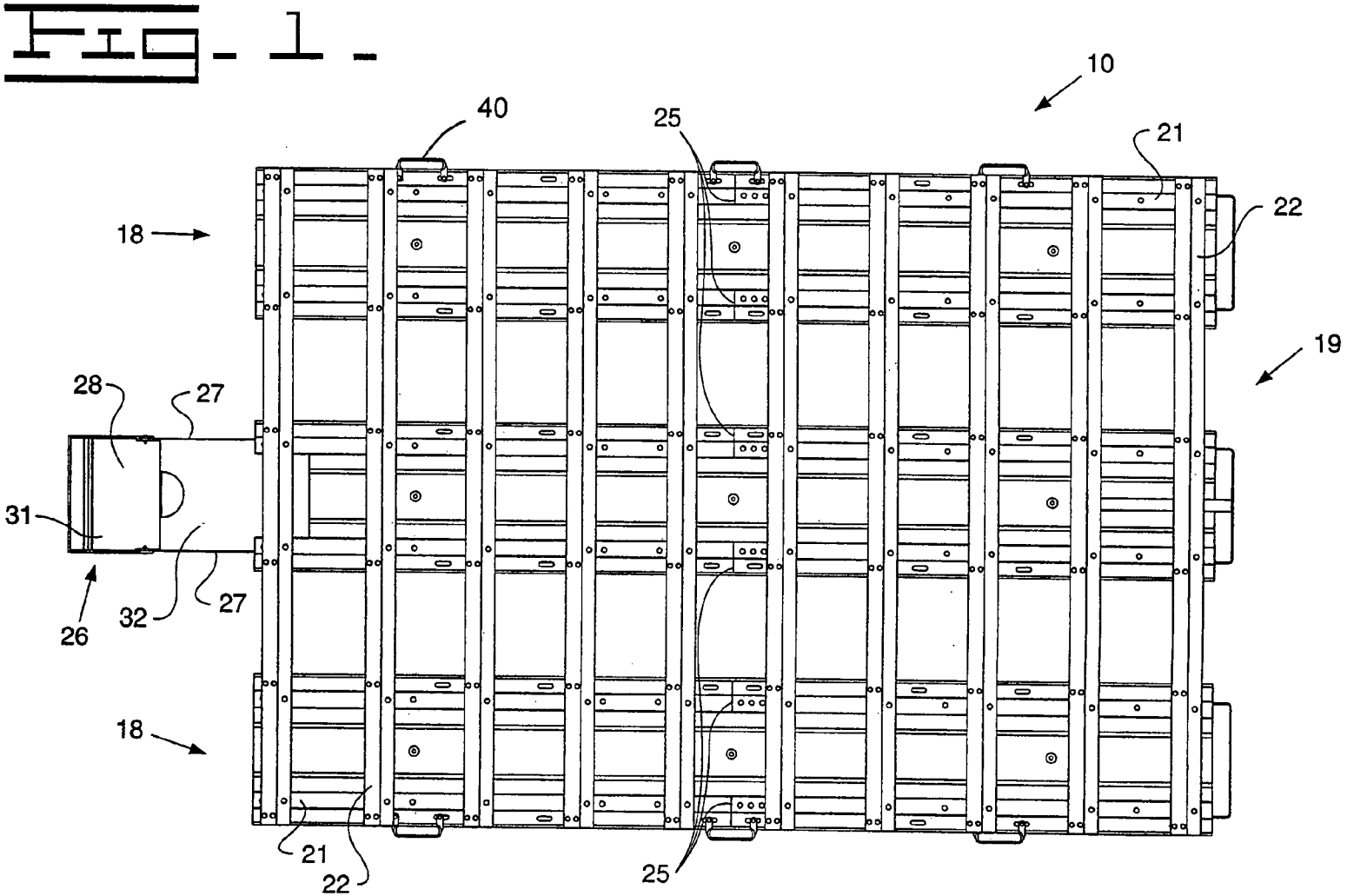
FIG. 1 is a top view of a mainframe attached to pontoons and a motor mount attached to the mainframe according to the present invention.
Figure 2:
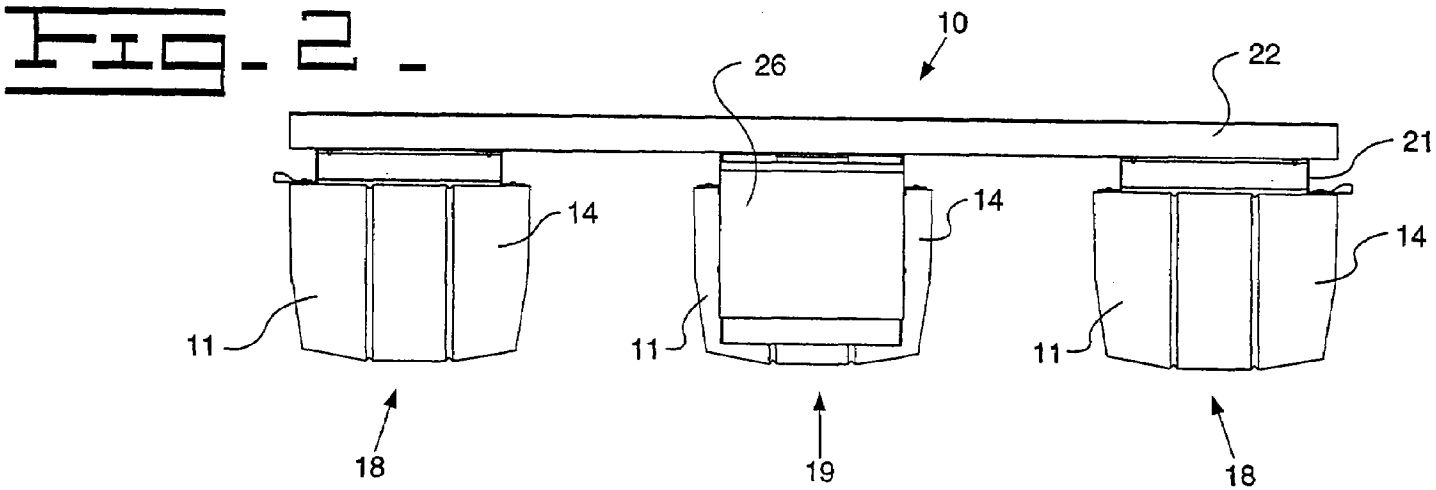
FIG. 2 is a back view of the mainframe attached to pontoons and the motor mount attached to the mainframe according to FIG. 1.
Figure 3:
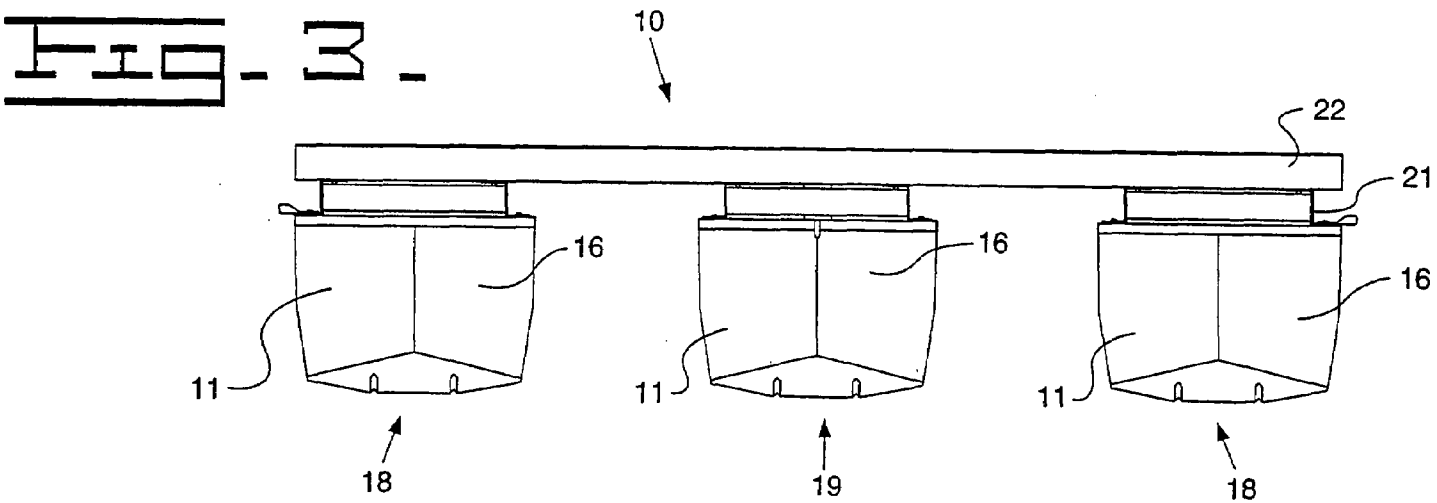
FIG. 3 is a front view of the mainframe attached to pontoons according to FIG. 1.

Referring to the accompanying drawings in which like reference numbers indicate like elements, FIGS. 1-5 illustrate a mainframe 10 operatively mounted to pontoons 11. The mainframe 10 and the pontoons 11 form part of a float structure, such as a pontoon boat, a pontoon dock, a pontoon duck blind or a pontoon working platform. Referring to FIG. 6, inserts 13 are molded into tops 12 of the pontoons 11. In the depicted embodiment, there are eight $3/8^{ths}$ of an inch stainless steel inserts 13 molded into the top 12 of each of the pontoons 11; however, other sizes may be used. Fasteners 20, such as bolts, are used to secure the mainframe 10 to the inserts 13 in the pontoons 11. In the depicted embodiment, there are preferably eight $3/8^{ths}$ of an inch stainless steel bolts 20. The use of molded inserts and fasteners has the benefit of providing a float structure that is easy to assemble and structurally sound.

In the depicted embodiments, the pontoons 11 are four feet in length; however, other lengths may be used. There are two types of pontoons 11 including a straight pontoon 14 for center and end sections and a sloped pontoon 15 for a front section. The sloped pontoon 15 has a sloped front section 16 and a flat back section 17. The sloped front section 16 is positioned ahead of the flat back section 17 in the direction of forward travel. The straight pontoons 14 are assembled to the flat back section 17 of the sloped pontoon 15. There are preferably two or more rows of pontoons 11 with each row having the sloped pontoon 15 at the forward most position of the row in the direction of forward travel. There are two outside rows 18 and one or more middle row 19 of the pontoons 11. For an eight feet by twelve feet mainframe 10, the outside rows 18 have pontoons 11 including one of the sloped pontoons 16 and two or more of the straight pontoons 14, and the middle rows 19 have one of the sloped pontoons 15 and either one or two of the straight pontoons 14. Handles 40 are mounted on the pontoons 11 for use in handling the assembled float structure. In the depicted embodiments, the handles 40 are attached with fasteners.

The mainframe 10 has pontoon connector beams 21 and floor support beams 22. The pontoon connector beams 21 and the floor support beams 22 are "Z" shaped, but other shapes, such as "C" shaped, may be used. The "Z" shaped beams 21, 22 can vary in size and are shown two inch by three inch by two inch, $1/8^{th}$ inch thick beams but other sizes may be used.

The pontoon connector beams 21 are longer than the length of one pontoon but shorter than the length of two pontoons. In the depicted embodiment, the pontoon connector beams 21 are approximately one and one-half times longer than the pontoons 11. This is significant because the relationship between the connector beams 21 and the pontoons 11 simultaneously allows for compactness of the unassembled parts and for strength of the assembled float structure. As an example, in the depicted embodiments the pontoon connector beams 21 are conveniently six feet in length; however, the connector beams 21 can vary in length. When assembling an eight feet by twelve feet mainframe 10, two of the pontoon connector beams 21, each being approximately six feet in length, are assembled in-line with respect to each other to the pontoons 11 with the bolts 20 and the inserts 13. Accordingly, the eight feet by twelve feet mainframe 10 utilizes three pontoons 11, each pontoon 11 being approximately four feet in length. The connector beams 21 are fastened directly to the tops of the pontoons 11 using vertically oriented fasteners. In other words, the fasteners are transverse to the top 12 of the pontoon 11. For example, bolts 20 threadingly engage inserts 13 molded directly into the tops of the pontoons 11. The use of inserts and fasteners allows even an amateur mechanic to quickly and easily assemble the float structure.

There are two rows of the in-line connector beams 21 assembled to each row of pontoons 11 for a total of six rows of the in-line connector beams 21. Each of the two in-line pontoon connector beams 21 abut each other at a first middle section 25 and are reinforced by back plates or back angles. The middle section 25 is at a longitudinal center of the pontoon 11 located after the sloped pontoon 15 in the direction of travel. This is a significant advantage because the weakest point of the in-line connector beams 21 is at the middle section 25 where the connector beams 21 abut each other.

The floor support beams 22 are then attached to the connector beams 21. The bottom sections of the "Z" floor support beams 22 are placed on the top of the "Z" connector beams 21. The floor support beams 22 are transverse to the connector beams 21. The top section of the "Z" floor support beams 22 is used to mount a pontoon floor thereto.

Figure 4:
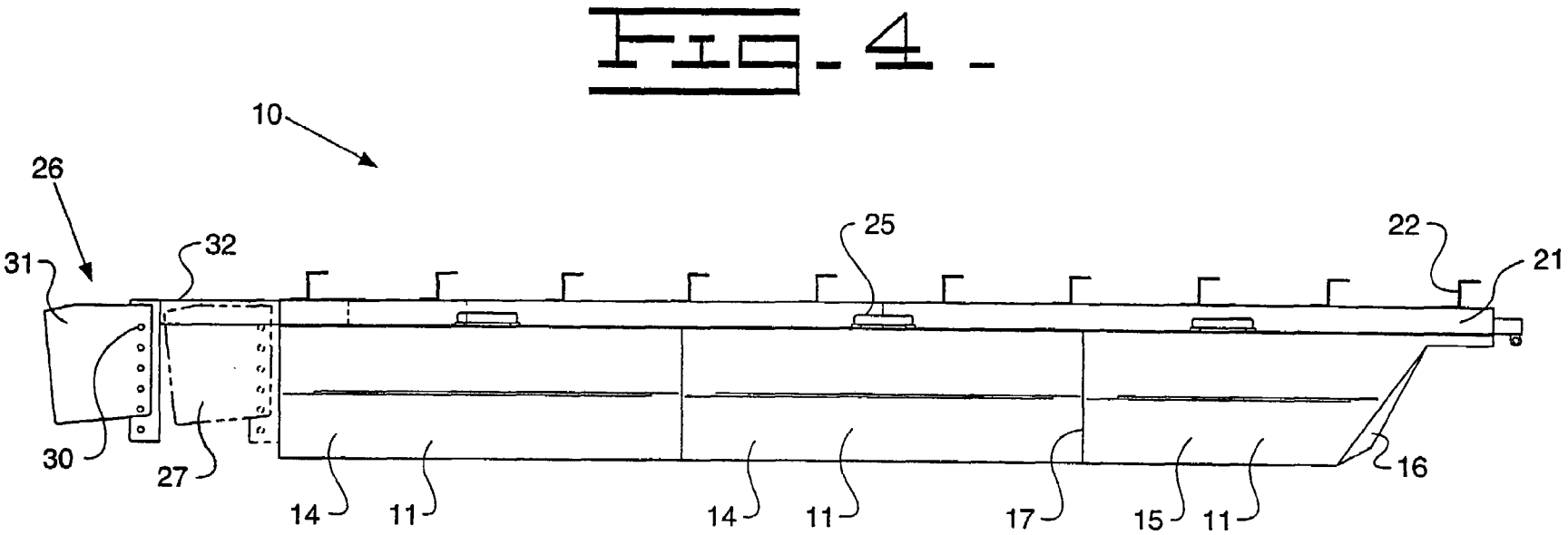
FIG. 4 is a side view of the mainframe attached to pontoons and the motor mount attached to the mainframe according to FIG. 1.
Figure 5:
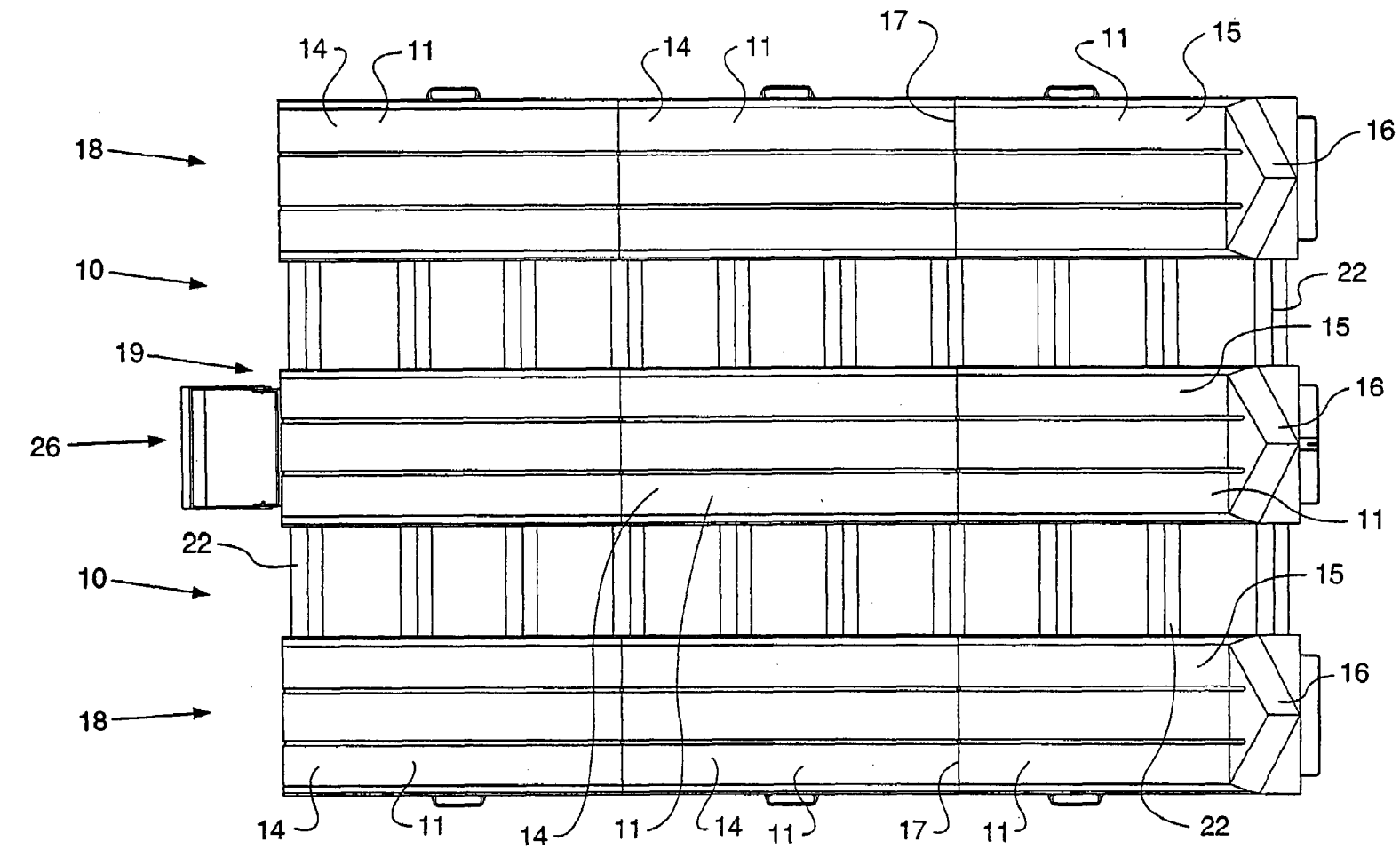
FIG. 5 is a bottom view of the mainframe attached to pontoons and the motor mount attached to the mainframe according to FIG. 1.
Figure 5:
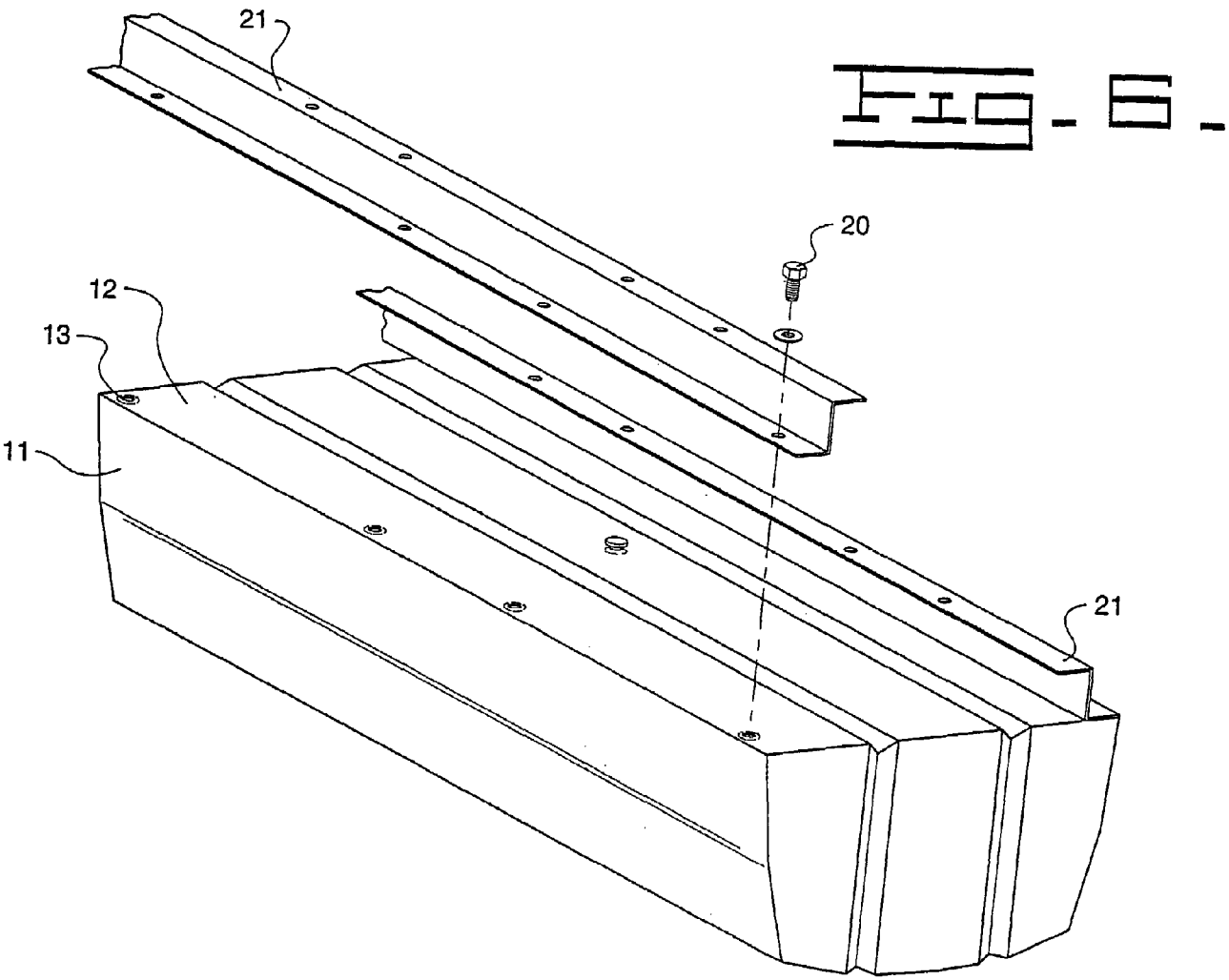

A motor mount 26 is removably mounted to the mainframe 10 of the pontoon boat. The motor mount 26 has "L" shaped sides 27, which slides into the "Z" shaped connector beams 21 best shown in FIGS. 1 and 4. FIG. 1 shows the motor mount 26 partially removed from the connector beams 21. FIG. 4 shows the motor mount 26 in two positions. The solid lines show the motor mount 26 partially removed from the connector beams 21, and the phantom lines show the motor mount 26 fully inserted into the connector beams 21 of the mainframe 10 in the use position 27. Referring again to FIG. 1, a motor (not shown) is fastened to part 28 of the motor mount 26. The motor mount 26 adjusts vertically, thereby lowering and raising the propeller shaft in relation to the water. This is a significant advantage because not all motors have consistent shaft lengths; therefore, the motor mount 26 is adjustable and provides a device for accommodating different lengths of motor shafts. Once the motor is positioned at a desired height, the motor mount 26 is held in position via bolts (not shown) placed through holes 30 in the motor mount 26 and secured with nuts (not shown). Specifically, the motor mount 26 has an motor mount assembly 31 and a horizontal support 32 best shown in FIGS. 1 and 4. The motor mount assembly 31 and the horizontal support 32 have vertical rows of holes 30. The motor mount assembly 31 moves vertically and the horizontal support 32 remains stationary. Once the motor and hence the propeller is positioned at a desired height, the motor mount assembly 31 and the horizontal support 32 are secured together via bolts placed through the holes 30 and held with nuts.

Figure 7:
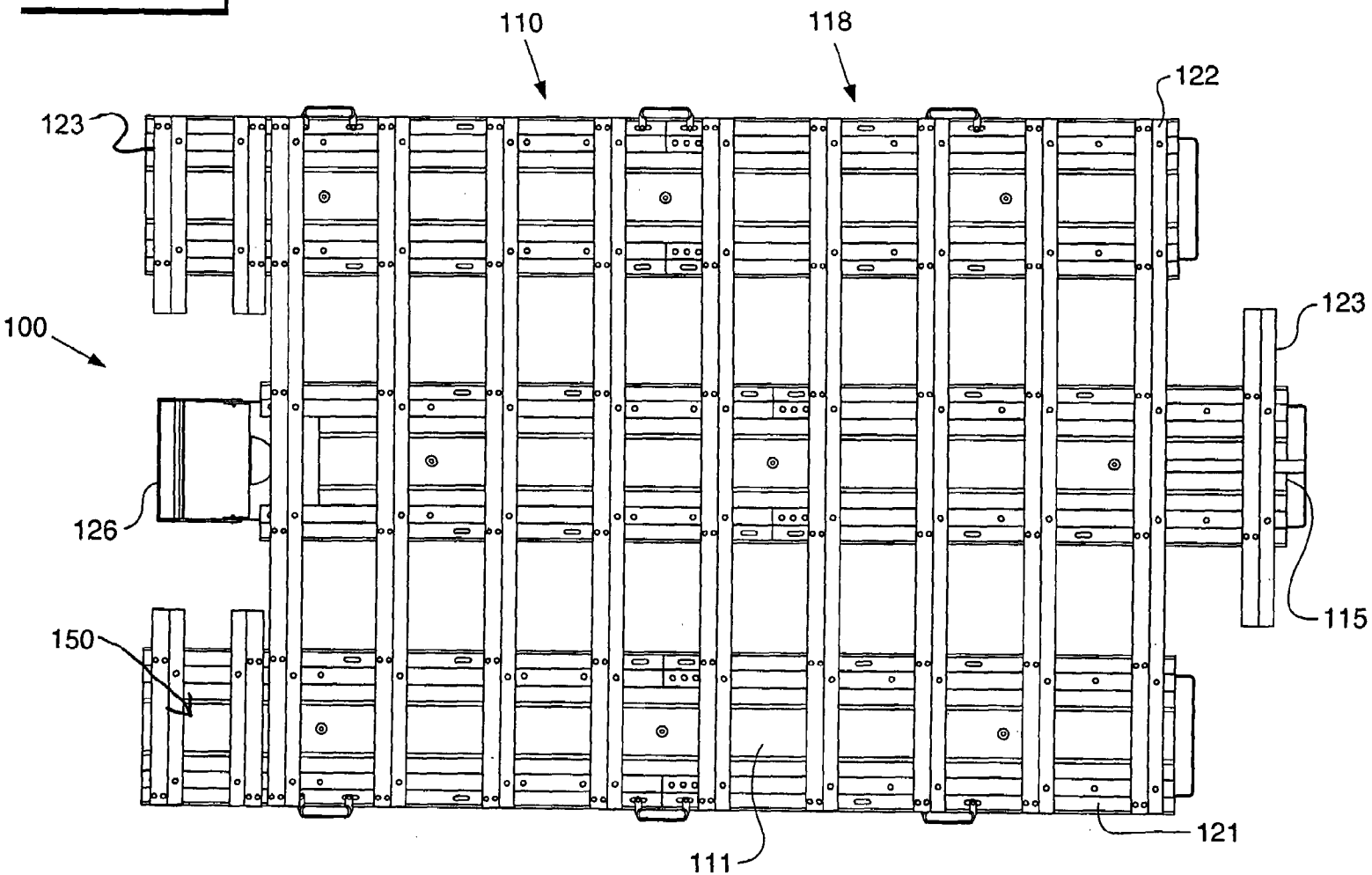
FIG. 7 is a top view of a mainframe attached to pontoons and a motor mount attached to the mainframe according to a second embodiment of the present invention.

FIG. 7 illustrates a second embodiment of the float structure, generally indicated by numeral reference 100. The float structure 100 includes a mainframe 110, pontoons 111, connector beams 121, and floor support beams 122. The float structure 100 has a middle row 115 and two outer rows 118. Each outer row 118 has an aft section 150 which may be sized to provide a function. In the depicted embodiment, the aft section 150 is dimensioned to receive a battery or a gas tank; however, those skilled in the art will understand that the aft section may be larger or smaller. The aft section is significant because pontoon boats typically lack a storage area for items generally used in operation of a motor, such as a gas can or battery. The middle row 115 is slightly forward of the outer rows 118. A floor support member 123 is operatively connected to the middle row 115. In some embodiments, each aft section 150 includes floor support members 123. The floor support member 123 is shorter than the floor support 122. In the depicted embodiment, the floor support member 123 is approximately two feet in length. A motor mount 126 is operatively connected to the middle row 115. In the depicted embodiment, the middle row 115 is about sixteen inches forward of the outer rows 118 such that the motor mount 126 is in-line with an imaginary line drawn between the two aft sections 150.

There is also a method of assembling a float structure. The method includes the steps of: providing at least two sloped pontoons each having a length; providing at least two connector beams each having a length approximately one and one-half times said length of said at least two sloped pontoons; connecting the two connector beams to each of the two sloped pontoons in a longitudinal direction; positioning the two sloped pontoons such that each of the two sloped pontoons are parallel to one another; providing two straight pontoons; positioning each of the two straight pontoons adjacent to each of the two sloped pontoons; connecting the two connector beams to each of the two straight pontoons in a longitudinal direction; and mounting transversely two floor support beams to the connector beams. An optional step includes connecting a motor mount to the two connector beams. Another optional step includes providing a reinforcement at the middle section.

In one embodiment the present invention is comprised of a float structure comprising a first pontoon row extending in a longitudinal direction, said first pontoon row having at least two pontoons, each of said at least two pontoons having a top, a bottom, and a length; at least one other pontoon row positioned parallel to said first pontoon row, said at least one other pontoon row having at least one pontoon, each of said at least one pontoon having a top, a bottom, and a length; and a mainframe, said mainframe comprising a plurality of connector beams, each of said plurality of connector beams connected to one of said at least one pontoon or said at least two pontoons at said top and in said longitudinal direction, and wherein each of said plurality of connector beams is longer than one of said length and shorter than two of said lengths; and a plurality of floor support beams operatively connected and transverse to said plurality of connector beams.

It may further comprise a plurality of inserts molded into said top of said at least one pontoon or said at least two pontoons.

It may further comprise each of said at least one pontoon or said at least two pontoons being selected from the group consisting of a sloped pontoon and a straight pontoon.

It may further comprise each of said plurality of connector beams being approximately one and one-half times the length of said at least one pontoon or said at least two pontoons.

It may further comprise each of said at least one pontoon or said at least two pontoons being approximately four feet in length.

It may further comprise each of said plurality of connector beams being approximately six feet in length.

It may further comprise said plurality of connector beams and said plurality of floor support beams being Z-shaped.

It may further comprise said at least one other pontoon row being selected from the group consisting of a middle row and an outside row.

It may further comprise at least one handle operatively connected to one of said at least one pontoon or said at least two pontoons.

It may further comprise each pontoon row including at least two of said plurality of connector beams.

It may further comprise each of said at least two of said plurality of connector beams being substantially parallel to another.

It may further comprise an adjustable motor mount removably connected to said mainframe.

It may further comprise an L-shaped side adapted for insertion into at least one of said plurality of connector beams.

It may further comprise a motor mount assembly operatively connected to said L-shaped side.

It may further comprise a horizontal support operatively connected to said motor mount assembly.

In another embodiment, the invention is a pontoon boat comprising a first outer pontoon row extending in a longitudinal direction, said first pontoon row having a sloped pontoon and at least two straight pontoons, each of said sloped pontoon and said at least two straight pontoons having a top, a bottom, and a length; a second outer pontoon row positioned parallel to said first outer pontoon row, said second outer pontoon row having a sloped pontoon and at least two straight pontoons, each of said sloped pontoon and said at least two straight pontoons having a top, a bottom, and a length; a central pontoon row positioned parallel to said first outer pontoon row and to said second outer pontoon row, said central pontoon row having a sloped pontoon and at least one straight pontoon, each of said sloped pontoon and said at least one straight pontoon having a top, a bottom, and a length; a mainframe, said mainframe comprising a plurality of Z-shaped connector beams, each of said plurality of Z-shaped connector beams operatively connected to one of said sloped pontoon and to one of said straight pontoon at said top and in said longitudinal direction, and wherein each of said plurality of Z-shaped connector beams is longer than one of said length and shorter than two of said lengths; a plurality of Z-shaped floor support beams operatively connected and transverse to said plurality of Z-shaped connector beams; and a motor mount removably connected to said mainframe.

It may comprise the pontoon boat wherein each of said sloped pontoon and said straight pontoon are four feet in length.

In another embodiment the invention may comprise the pontoon boat, wherein said motor mount comprises at least one L-shaped side adapted for insertion into at least one of said plurality of Z-shaped connector beams; a motor mount assembly operatively connected to said at least one L-shaped side; and a horizontal support operatively connected to said motor mount assembly.

The pontoon boat may further comprise a plurality of vertical holes located in said motor mount assembly.

The pontoon boat may further have a central pontoon row is forward of said first pontoon row or said second pontoon row.

The pontoon boat may further comprise a floor support member operatively connected to said central pontoon row.

The pontoon boat may further have a first pontoon row and said second pontoon row each include an aft section.

The pontoon boat wherein said aft section is dimensioned to receive a gas can or a battery.

The pontoon boat wherein said motor mount is in-line with an imaginary line drawn between said aft sections.

In another embodiment the invention is a method of assembling a float structure, the method comprising the steps of providing at least two sloped pontoons, each of said at least two sloped pontoons having a length; providing at least two connector beams each having a length approximately one and one-half times said length of said at least two sloped pontoons; connecting said at least two connector beams to each of said at least two sloped pontoons in a longitudinal direction; positioning said at least two sloped pontoons such that each of said at least two sloped pontoons are parallel to one another; providing at least two straight pontoons; positioning each of said at least two straight pontoons adjacent to each of said at least two sloped pontoons; connecting said at least two connector beams to each of said at least two straight pontoons in a longitudinal direction; and mounting transversely at least two floor support beams to said connector beams.

It may comprise the step of connecting a motor mount to said at least two connector beams.

It may comprise the method the step of providing a reinforcement at a middle section.

In another embodiment the invention is a float structure comprising a first pontoon row extending in a longitudinal direction, said first pontoon row having at least one pontoon, each of said at least one pontoons having a top, a bottom, and a length, and a plurality of inserts molded into said top of said at least one pontoon; at least one other pontoon row positioned parallel to said first pontoon row, said at least one other pontoon row having at least one pontoon, each of said at least one pontoon having a top, a bottom, and a length, and a plurality of inserts molded into said top of said at least one pontoon; and a mainframe, said mainframe comprising a plurality of connector beams, each of said plurality of connector beams connected to one of said at least one pontoon or said at least two pontoons at said top and in said longitudinal direction, and wherein each of said plurality of connector beams is longer than one of said length and shorter than two of said lengths; a plurality of fasteners adapted for engagement with said plurality of inserts, said plurality of fasteners interconnecting said plurality of connector beams to said at least one pontoon, each of said plurality of fasteners oriented substantially transverse to said top of said at least one pontoon; and a plurality of floor support beams operatively connected and transverse to said plurality of connector beams.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, while the depicted embodiments include the motor mount 26, in some embodiments it may be omitted. Thus, the breadth and scope of the present invention should not be limited by any of the above-described exemplary embodiments, but should be defined only in accordance with the following claims appended hereto and their equivalents.

What is claimed is:

1. A pontoon boat comprising:

a. a first out pontoon row extending in a longitudinal direction, said first pontoon row having an inclined bow pontoon and at least two straight pontoons, each of said inclined bow pontoons and said at least two straight pontoons having a top, a bottom, and a length;

b. a second outer pontoon row positioned parallel to said first outer pontoon row, said second outer pontoon row having an inclined bow pontoon and at least two straight pontoons having a top, a bottom, and a length;

c. a central pontoon row positioned parallel to said first outer pontoon row and to said second outer pontoon row, said central pontoon row having an inclined bow pontoon and at least one straight pontoon, each of said sloped pontoon and said at least one straight pontoon having a top, a bottom, and a length;

d. a mainframe, said mainframe comprising:

i. a plurality of Z-shaped connector beams, at least one of said plurality of Z-shaped connector beams operatively connected to one of said inclined bow pontoons and to one of said straight pontoon at said top and in said longitudinal direction, and wherein each of said plurality of Z-shaped connector beams is longer than one of said length and shorter than two of said lengths; and ii. a plurality of Z-shaped floor support beams operatively connected and transverse to said plurality of Z-shaped connector beams.

2. A pontoon boat according to claim 1 wherein each of said inclined bow pontoons and said straight pontoon are four feet in length.

3. A pontoon boat according to claim 1 including a motor mount comprising:

a. at least one L-shaped side adapted for insertion into at least one of said plurality of Z-shaped connector beams;

b. a motor mount assembly operatively connected to said at least one L-shaped side; and c. a horizontal support operatively connected to said motor mount assembly.

4. A pontoon boat according to claim 1 further comprising a plurality of vertical holes located in a motor mount assembly.

5. A pontoon boat according to claim 1 wherein said central pontoon row is forward of said first outer pontoon row or said second outer pontoon row.

6. A pontoon boat according to claim 1 wherein said first outer pontoon row and said second outer pontoon row each include an aft section.

7. A pontoon boat according to claim 1 wherein an aft section is dimensioned to receive a gas can or a battery.

8. A pontoon boat according to claim 1 wherein a motor mount is in-line with an imaginary line drawn between aft sections.

* * * * *